US011008882B2

(12) United States Patent
Dierksmeier

(10) Patent No.: US 11,008,882 B2
(45) Date of Patent: May 18, 2021

(54) BLADE TIP CLEARANCE ASSEMBLY

(71) Applicant: Rolls-Royce North American Technologies Inc., Indianapolis, IN (US)

(72) Inventor: Douglas David Dierksmeier, Franklin, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 6 days.

(21) Appl. No.: 16/388,129

(22) Filed: Apr. 18, 2019

(65) Prior Publication Data

US 2020/0332671 A1 Oct. 22, 2020

(51) Int. Cl.

| | |
|---|---|
| ***F01D 11/22*** | (2006.01) |
| ***F01D 9/04*** | (2006.01) |
| ***F01D 25/24*** | (2006.01) |
| *F01D 11/14* | (2006.01) |

(52) U.S. Cl.

CPC ..... *F01D 11/22* (2013.01); *F01D 9/042* (2013.01); *F01D 25/246* (2013.01); *F01D 11/14* (2013.01); *F05D 2220/32* (2013.01)

(58) Field of Classification Search

CPC ..... F01D 11/20; F01D 11/22; F01D 11/14; F01D 9/042; F01D 25/246

See application file for complete search history.

(56) References Cited

U.S. PATENT DOCUMENTS 3,085,398 A * 4/1963 Ingleson ..... F01D 11/22 415/127
3,854,843 A * 12/1974 Penny ..... F01D 11/18 415/197
4,330,234 A * 5/1982 Colley ..... F01D 11/22 415/127
5,018,942 A 5/1991 Ciokajlo et al.

(Continued)

FOREIGN PATENT DOCUMENTS

GB 2068470 A * 8/1981 ..... F01D 11/22
GB 2099515 A * 12/1982 ..... F01D 11/22

OTHER PUBLICATIONS

Lattime, S.B., et al., "Turbine Engine Clearance Control Systems: Current Practices and Future Directions", Joint Propulsion Conference & Exhibit, Jul. 2002, NASA TM-2002-211794, 22pgs.

(Continued)

*Primary Examiner* — Brian P Wolcott
*Assistant Examiner* — Behnoush Haghighian
(74) *Attorney, Agent, or Firm* — Brinks Gilson & Lione

(57) ABSTRACT

An assembly is disclosed for adjusting the radial position of one or more blade tracks radially encasing the blades of a turbine stage in a gas turbine engine. The assembly comprises a static turbine casing, a plurality of blade track carriers, an annular control ring, an actuator, and a plurality of blade tracks. The blade tracks have a radially inner surface that defines a flowpath boundary of the turbine stage. The blade tracks are carried by the blade track carriers, which are engaged with the annular control ring. Actuation of the actuator moves the control ring in an axial dimension and this movement is translated into an adjustment of the radial position of the blade track.

20 Claims, 5 Drawing Sheets

(56) References Cited

U.S. PATENT DOCUMENTS

| | | | | |
|---|---|---|---|---|
| 5,035,573 | A * | 7/1991 | Tseng | F01D 11/22 415/126 |
| 5,049,033 | A | 9/1991 | Corsmeier et al. | |
| 5,362,202 | A * | 11/1994 | Derouet | F01D 11/22 415/148 |
| 6,607,350 | B2 * | 8/2003 | Dodd | F01D 11/22 415/126 |
| 7,575,409 | B2 * | 8/2009 | Dierksmeier | F01D 11/22 415/1 |
| 8,277,177 | B2 * | 10/2012 | Liang | F02C 7/12 415/173.1 |
| 8,678,742 | B2 * | 3/2014 | Klingels | F01D 11/22 415/1 |
| 9,068,471 | B2 * | 6/2015 | Klingels | F01D 11/22 |
| 9,587,507 | B2 * | 3/2017 | Ottow | F01D 11/22 |
| 9,752,450 | B2 * | 9/2017 | Duguay | F01D 25/24 |
| 9,784,117 | B2 * | 10/2017 | Duguay | F01D 11/14 |
| 9,915,163 | B2 | 3/2018 | McCaffrey | |
| 9,963,990 | B2 | 5/2018 | Vetters et al. | |
| 10,066,497 | B2 | 9/2018 | Duguay | |
| 10,087,770 | B2 | 10/2018 | Vetters et al. | |
| 10,221,713 | B2 | 3/2019 | Vetters et al. | |
| 10,301,961 | B2 * | 5/2019 | Davis | F01D 11/14 |
| 10,662,804 | B2 * | 5/2020 | Awtry | F02C 3/06 |
| 2010/0183426 | A1 * | 7/2010 | Liang | F02C 7/12 415/110 |
| 2012/0063884 | A1 * | 3/2012 | Klingels | F01D 11/22 415/1 |
| 2013/0315716 | A1 * | 11/2013 | Cotroneo | F01D 11/22 415/130 |
| 2015/0016946 | A1 * | 1/2015 | Ottow | F01D 11/22 415/1 |
| 2016/0356168 | A1 * | 12/2016 | Duguay | F01D 11/22 |
| 2016/0356169 | A1 * | 12/2016 | Duguay | F01D 11/20 |
| 2016/0356170 | A1 * | 12/2016 | Davis | F04D 29/164 |
| 2017/0044920 | A1 | 2/2017 | Vetters et al. | |
| 2017/0044921 | A1 | 2/2017 | Vetters et al. | |
| 2017/0306785 | A1 | 10/2017 | Rioux et al. | |
| 2017/0328230 | A1 | 11/2017 | Virkler | |
| 2018/0283196 | A1 | 10/2018 | Powell | |
| 2020/0040755 | A1 * | 2/2020 | Clark | F01D 25/246 |

OTHER PUBLICATIONS

Peng, K., et al., "Active Generalized Predictive Control of Turbine Tip Clearance for Aero-Engines", Chinese Journal of Aeronautics, Oct. 2013, vol. 26, Issue 5, pp. 1147-1155.

* cited by examiner

BLADE TIP CLEARANCE ASSEMBLY

BACKGROUND

Rotating machines may comprise a bladed disc, typically attached to a rotating shaft, encased by a shroud. Examples include axial compressors, centrifugal compressors, and turbines.

In many applications of rotating machines, such as a gas turbine engine, systems and methods are employed to ensure an appropriate gap is maintained between the blade tips of the bladed disc and the shroud. This gap is often referred to as the blade tip clearance, and is an important factor in determining the efficiency of an engine. An insufficient gap increases the risk that a blade tip will impinge—or rub—against the shroud, potentially damaging one or both of the blades and shroud and ultimately reducing engine efficiency. Conversely, when an excessive gap exists gasses flowing through the engine may pass between the blade tips and the shroud, thus constituting leakage which also reduces the engine efficiency. Maintaining an appropriately-sized blade tip clearance through a wide range of operating conditions and transients is therefore important to the efficient operation of a turbine engine or, indeed, many rotating machines.

SUMMARY

According to some aspects of the present disclosure, an assembly for adjusting the radial position of one or more blade tracks radially encasing the blades of a turbine stage in a gas turbine engine may include a static turbine casing, a plurality of blade track carriers carried by the casing, the plurality of blade track carriers may form a segmented annular member extending around a circumference of and radially inward of the turbine casing. Each of the blade track carriers may include a carrier flange and a ring engagement member extending radially outward from the carrier flange. An annular control ring may be carried by the turbine casing, and may be positioned radially outward of and in axial alignment with the ring engagement member of each blade track carrier. The control ring may have a radially inner track engagement surface having a radial dimension varying in an axial direction, and may be moveable in the axial direction. The assembly may also include an actuator for moving the control ring in the axial direction while the control ring is engaged with the ring engagement members of the blade track carriers. The assembly may also include a plurality of blade tracks, each of which blade track may be carried by a blade track carrier and may have a radially inner surface forming at least a part of a radially outer flowpath boundary in a turbine stage.

In some embodiments, the ring engagement member may include one or more radially oriented rotatable wheels. In some embodiments, the actuator may include a lever arm coupled to the control ring by one or more linkages. In some embodiments, each blade track may be biased in a radially outward direction. In some embodiments, each blade track may be coupled to and spaced from the turbine casing by one or both of a forward hoop and an aft hoop. In some embodiments, each blade track may include a forward mount arm and an aft mount arm and each blade track carrier may include a forward hook and aft hook, and wherein one or more of the plurality of blade tracks may be carried by one or more of the plurality of blade track carriers with the forward mount arm engaged with the forward hook and the aft mount arm engaged with the aft hook. In some embodiments, the radial position of one or more blade tracks are adjusted based on a sensed clearance gap between the blade track and the blades of the turbine stage. In some embodiments, the radial position of one or more blade tracks are adjusted based on an inferred clearance gap between the blade track and the blades of the turbine stage.

According to some aspects of the present disclosure, an assembly for adjusting the radial position of one or more blade tracks radially encasing the blades of a turbine stage in a gas turbine engine, the assembly may include a static turbine casing. A plurality of blade track carriers may be carried by the casing. The plurality of blade track carriers may form a segmented annular member which may extend around a circumference of and radially inward of the turbine casing. Each of the blade track carriers may include a carrier flange and a ring engagement member extending radially outward from the carrier flange. The assembly may include an annular control ring carried by the turbine casing, and may be positioned radially outward of and in axial alignment with the ring engagement member of each blade track carrier. The control ring may have a radially inner track engagement surface having a radial dimension varying in an axial direction, the control ring may be moveable in the axial direction. At least three actuators may be spaced about the circumference of the turbine casing. Each actuator may move the control ring in the axial direction while the control ring may be engaged with the ring engagement members of the blade track carriers. The assembly may include a plurality of blade tracks. Each blade track may be carried by a blade track carrier and having a radially inner surface forming at least a part of a radially outer flowpath boundary in a turbine stage.

In some embodiments, each of the at least three actuators are adapted to be actuated in unison to effect substantially uniform movement of the control ring in the axial direction. In some embodiments, the radial position of one or more blade tracks may be adjusted symmetrically with respect to an axis of rotation of the turbine stage. In some embodiments, each of the at least three actuators are adapted to be actuated individually to effect substantially non-uniform movement of the control ring in the axial direction. In some embodiments, the radial position of one or more blade tracks may be adjusted asymmetrically with respect to an axis of rotation of the turbine stage. In some embodiments, each of the at least three actuators may include a lever arm coupled to the control ring by one or more linkages. In some embodiments, each blade track may be biased in a radially outward direction.

According to some aspects of the present disclosure, a turbine engine with a static turbine casing and a turbine stage may have a method of reducing blade tip rub which may include carrying a plurality of blade tracks with one or more blade track carriers, each blade track may include a radially inner surface forming a portion of a radially outer flowpath boundary of the turbine stage. The method may include engaging the one or more blade track carriers with an annular control ring, each of the blade track carriers may include a carrier flange and a ring engagement member extending radially outward from the carrier flange and the control ring may include a radially inner track engagement surface having a radial dimension varying in an axial dimension. The method may also include moving the control ring in an axial direction while the control ring is engaged with the ring engagement member of the blade track carriers to adjust a radial position of the radially inner surface of the blade track.

In some embodiments the annular control ring may be coupled to an actuator, the method then may include actuating the actuator to move the control ring in an axial direction. In some embodiments, the actuator may include a lever arm coupled to the control ring by one or more linkages, and actuating the actuator may include articulating the lever arm. In some embodiments, the method may further include measuring a clearance gap between a blade tip of the turbine stage and the radially inner surface of the blade tracks. The control ring may be moved the in an axial direction responsive to the measured clearance gap. In some embodiments, the method may further include inferring a clearance gap between a blade tip of the turbine stage and the radially inner surface of the blade tracks. The control ring may be moved in an axial direction responsive to the inferred clearance gap.

BRIEF DESCRIPTION OF THE DRAWINGS

The following will be apparent from elements of the figures, which are provided for illustrative purposes.

Figure 1A:
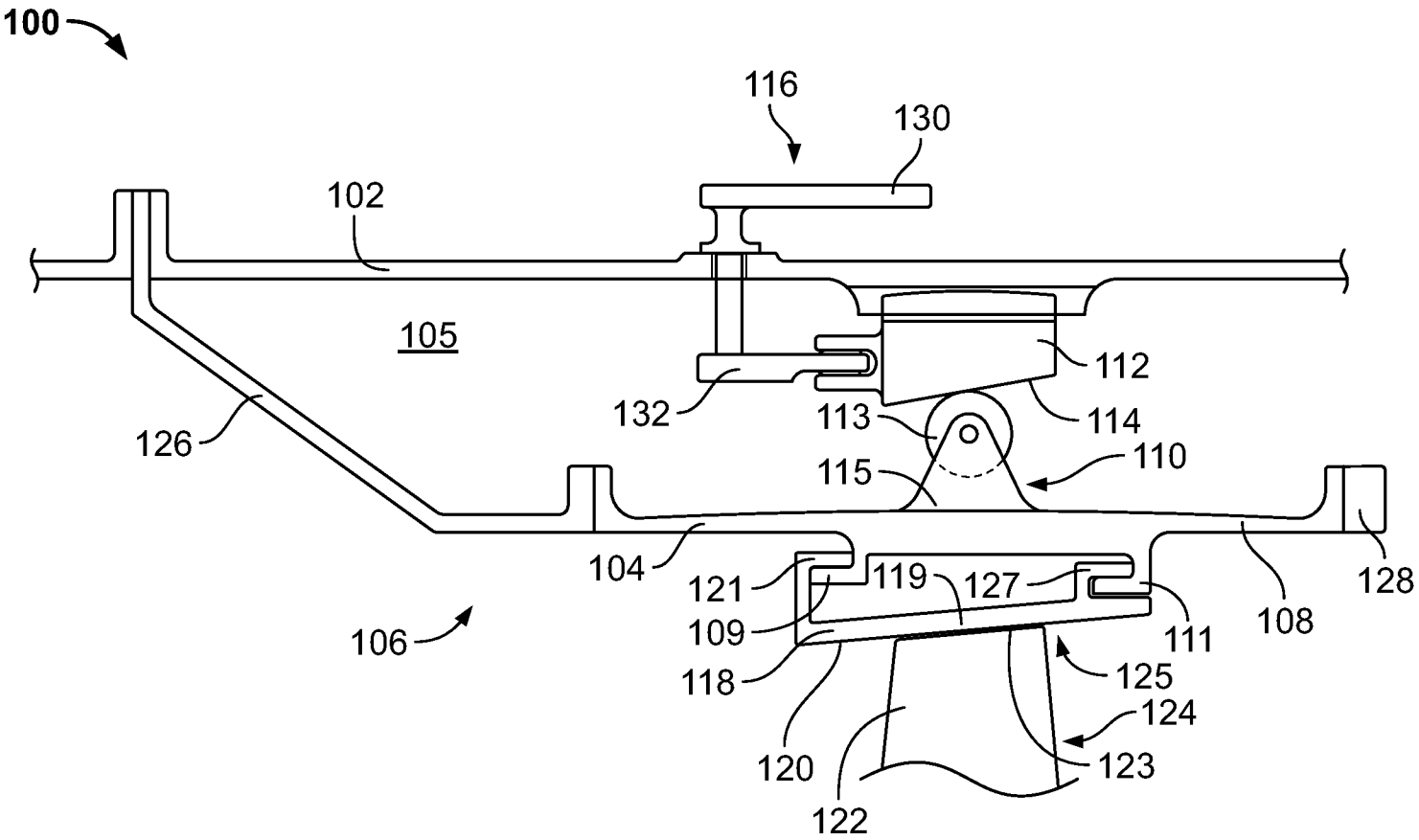
FIG. 1A is a schematic and cross sectional view of a blade tip clearance control assembly in accordance with some embodiments of the present disclosure.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

Existing solutions for maintaining an appropriately-sized blade tip clearance through a wide range of operating conditions and transients typically requires the use of complex pneumatic systems such as those that use cooling air to position a shroud relative to blade tips. For example, in certain blade tip clearance systems in use today, the shroud and an engine casing thermally expand together, and cooling air is applied to the engine casing to reduce thermal expansion and thus hold the shroud in an appropriate radial position relative to a rotating blade.

Many blade tip clearance systems are complex, have many parts, and are expensive to both manufacture and maintain. Further, some systems rely on thermally expanding and contracting the shroud to adjust the radial positioning of the shroud; these systems often have a substantial delay time when responding to operating transients and don't allow for precise adjustments to the radial position of the shroud.

The present disclosure is therefore directed to systems and methods to overcome the aforementioned shortcomings of the prior art. More specifically, the present disclosure is directed to an assembly for adjusting the radial position of a blade track of a shroud relative to blade tips that has a mechanical actuator that allows for rapid and precise radial positioning of a blade track. The present disclosure is further directed to methods of controlling the radial position of a blade track and/or reducing blade tip rub.

Figure 1B:
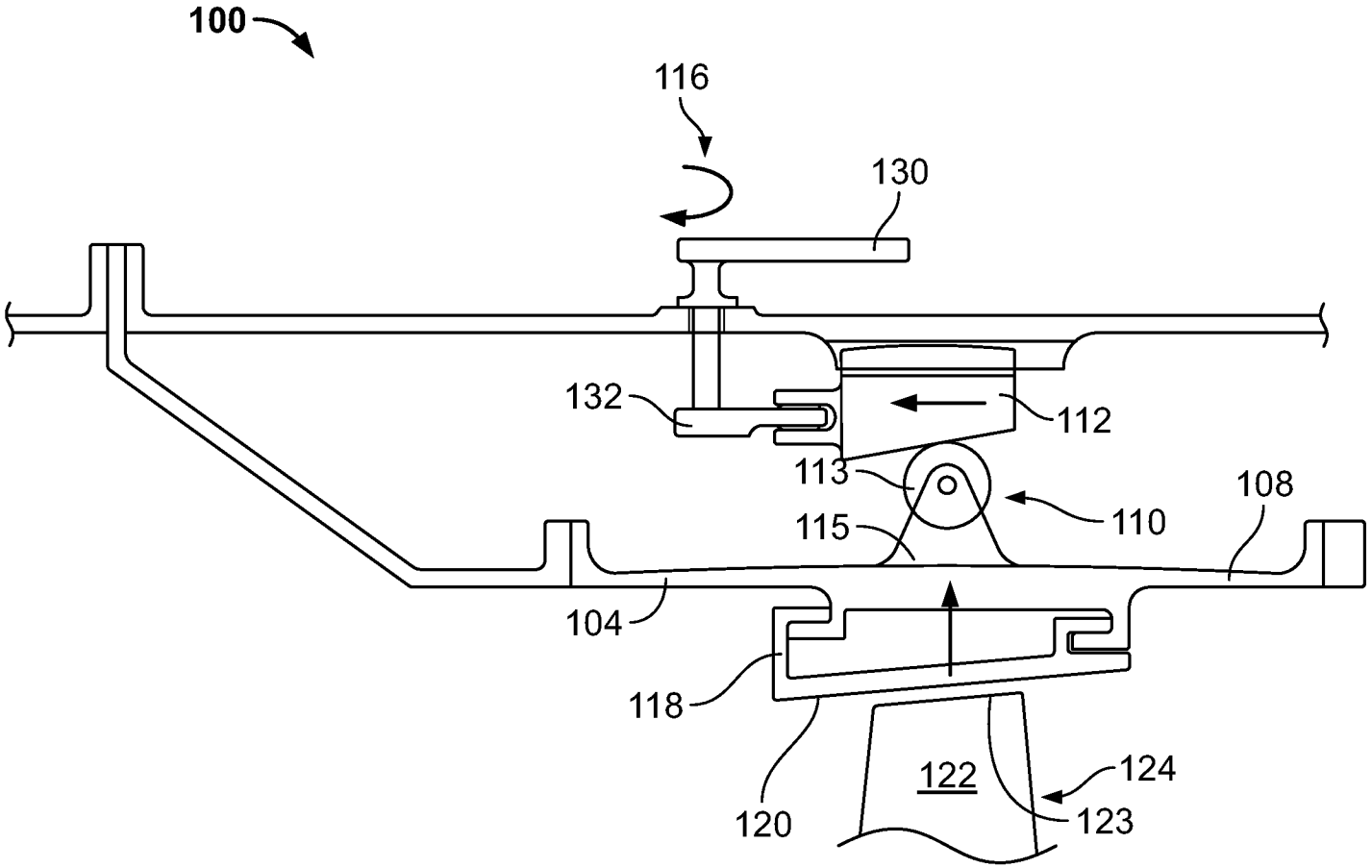
FIG. 1B is a schematic and cross sectional view of a blade tip clearance control assembly showing a radially outward adjustment of the position of a blade track in accordance with some embodiments of the present disclosure.
Figure 1C:
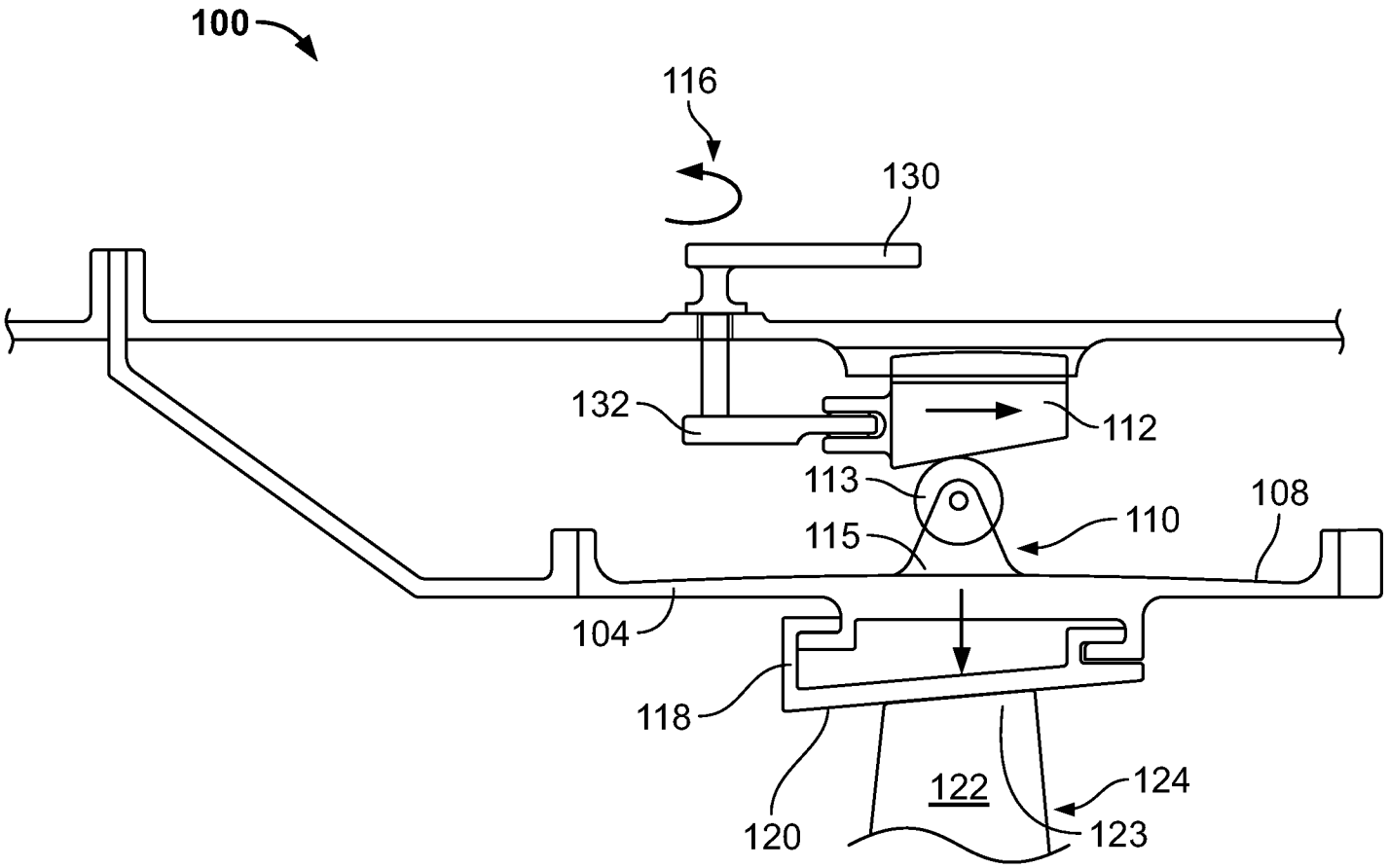
FIG. 1C is a schematic and cross sectional view of a blade tip clearance control assembly showing a radially inward adjustment of the position of a blade track in accordance with some embodiments of the present disclosure.

FIG. 1A provides a schematic and cross sectional view of an assembly 100 for adjusting the radial position of a blade track 118 relative to blade tips 123. FIGS. 1B and 1C provide schematic and cross sectional views showing adjustments to the radial position of a bade track 118. FIGS. 1A, 1B, and 1C each provide cross sectional views with a cross section taken along an axis of rotation of the gas turbine engine.

An assembly 100 for adjusting the radial position of one or more blade tracks 118 may comprise a static turbine casing 102, a plurality of blade track carriers 104, an annular control ring 112, an actuator 116, and a plurality of blade tracks 118. The static turbine casing 102 may at least partly encase a turbine stage 124 of a gas turbine engine or similar rotating machine. The turbine stage 124 may comprise a bladed disk having a plurality of blades 122 spaced about the circumference of and extending radially outward from a rotor. Each blade 122 terminates in a blade tip 123.

A plurality of blade track carriers 104 are carried by the turbine casing 102 and form a segmented annular member 106 that extends around a circumference of the turbine casing 102 and is spaced radially inward from the turbine casing 102. The turbine casing 102 and plurality of blade track carriers 104 may at least partly define an annulus 105 that spaces the blade track carriers 104 from the turbine casing 102. Each blade track carrier 104 may be coupled to the turbine casing 102 by a forward hoop 126 and/or an aft hoop 128.

Each blade track carrier 104 may comprise a carrier flange 108 and a ring engagement member 110. The carrier flange 108 may extend substantially in an axial dimension and may extend between a forward hoop 126 and an aft hoop 128. The ring engagement member 110 may extend from a radially outward facing surface of the carrier flange 108. The ring engagement member 110 may comprise a wheel 113 rotatably carried by a wheel flange 115. The wheel 113 may be radially oriented. A forward hook 109 and aft hook 111 may extend from a radially inward facing surface of the carrier flange 108.

The annular control ring 112 may be carried by the turbine casing 102. The control ring 112 may be positioned radially outward of and in axial alignment with the ring engagement member 110 of each blade track carrier 104. The control ring 112 may have a radially inner track engagement surface 114. The track engagement surface 114 may have a radial dimension varying in the axial dimension. As shown in FIG. 1A, a forward edge of the track engagement surface 114 is positioned radially inward from an aft edge of the track engagement surface 114. The control ring 112 may be moveable in an axial direction.

The control ring 112 may be coupled to an actuator 116 for moving the control ring 112 in an axial direction while engaging the ring engagement members 110 of the blade track carriers 104. In some embodiments the actuator 116 may comprise one or more lever arms 130 coupled to the control ring 112 by one or more linkages 132. Articulation of a lever arm 130 is translated through the linkages 132 to effect axial movement of the control ring 112. In other embodiments the actuator 116 may be a pneumatic, hydraulic, electric, or mechanical actuator 116.

Each of the plurality of blade tracks 118 is carried by a blade track carrier 104 and has a radially inner surface 120 forming at least a part of a radially outer flowpath boundary in a turbine stage 124. Each blade track 118 may comprise a blade facing flange 119 having radially inner surface 120, a forward mount arm 121, and an aft mount arm 127. A blade track 118 may be carried by one or more blade track carriers 104 with the forward mount arm 121 engaged with the forward hook 109 and the aft mount arm 127 engaged with the aft hook 111. Each blade track 118 may be biased in a radially outward direction.

A blade tip clearance 125 is the distance between a blade tip 123 and the radially inner surface 120 of a blade track 118. The radially inner surface 120 of each blade track 118 may be angled relative to the axis of rotation of the turbine stage 124. As shown in FIG. 1A, the radially inner surface 120 may be angled such that a forward edge of the blade track 118 is positioned radially inward from an aft edge of the blade track 118.

During operation, the blade tip clearance 125 may be measured, for example with sensors positioned at, in, on, or proximate the radially inner surface 120, or may be inferred, for example through the use of a parameter schedule that correlates various operating conditions of the engine with an expected clearance 125. The radial position of a blade track 118, and thus the blade tip clearance 125, may also be controlled on a schedule based on operating parameters and conditions or the engine mode.

If the blade tip clearance 125 is determined to be too small, thus risking impingement of a blade tip 123 against the radially inner surface 120, then the radial position of one or more blade tracks 118 may be adjusted. The determination that a blade tip clearance 125 is too small may be made at a controller. The determination that a blade tip clearance 125 is too small may be made by comparing a measured or inferred clearance 125 with a predetermined maximum desired clearance.

FIG. 1B shows movement of various components of the assembly 100 to adjust the radial position of one or more blade tracks 118. The actuator 116 may be actuated to axially move the control ring 112 and thus adjust the radial position of one or more blade tracks 118. More specifically, one or more lever arms 130 may be articulated, and the articulation may be translated to the control ring 112 via one or more linkages 132. In the disclosed embodiment the lever arm is articulated in a clockwise direction. The control ring 112 is moved axially forward. Since the engagement surface 114 slopes in a radially outward direction moving fore to aft along the engagement surface 114, an axially forward movement of the control ring 112 allows the blade track carrier 104, which may be biased in a radially outward direction, to move radially outwardly. The wheel 113 may rotate and track along the engagement surface 114, allowing the blade track 118 to move in a radially outward direction to adjust the radial positioning of the blade track 118 relative to blade tips 123.

Similarly, the blade tip clearance 125 may be determined to be too large. If the blade tip clearance 125 is determined to be too large, thus reducing efficiency of the turbine stage 124 due to leakage between blade tips 123 and radially inner surface 120, then the radial position of one or more blade tracks 118 may be adjusted. The determination that a blade tip clearance 125 is too large may be made at a controller. The determination that a blade tip clearance 125 is too large may be made by comparing a measured or inferred clearance 125 with a predetermined maximum desired clearance.

FIG. 1C shows movement of various components of the assembly 100 to adjust the radial position of one or more blade tracks 118. The actuator 116 may be actuated to axially move the control ring 112 and thus adjust the radial position of one or more blade tracks 118. More specifically, one or more lever arms 130 may be articulated, and the articulation may be translated to the control ring 112 via one or more linkages 132. In the disclosed embodiment the lever arm 130 is articulated in a counterclockwise direction. The control ring 112 is moved axially aft. Since the engagement surface 114 slopes in a radially outward direction moving fore to aft along the engagement surface 114, an axially aft movement of the control ring 112 allows the blade track carrier 104, which may be biased in a radially outward direction, to move radially inwardly. The wheel 113 may rotate and track along the engagement surface 114, pushing the blade track 118 to move in a radially inward direction to adjust the radial positioning of the blade track 118 relative to blade tips 123.

Figure 2:
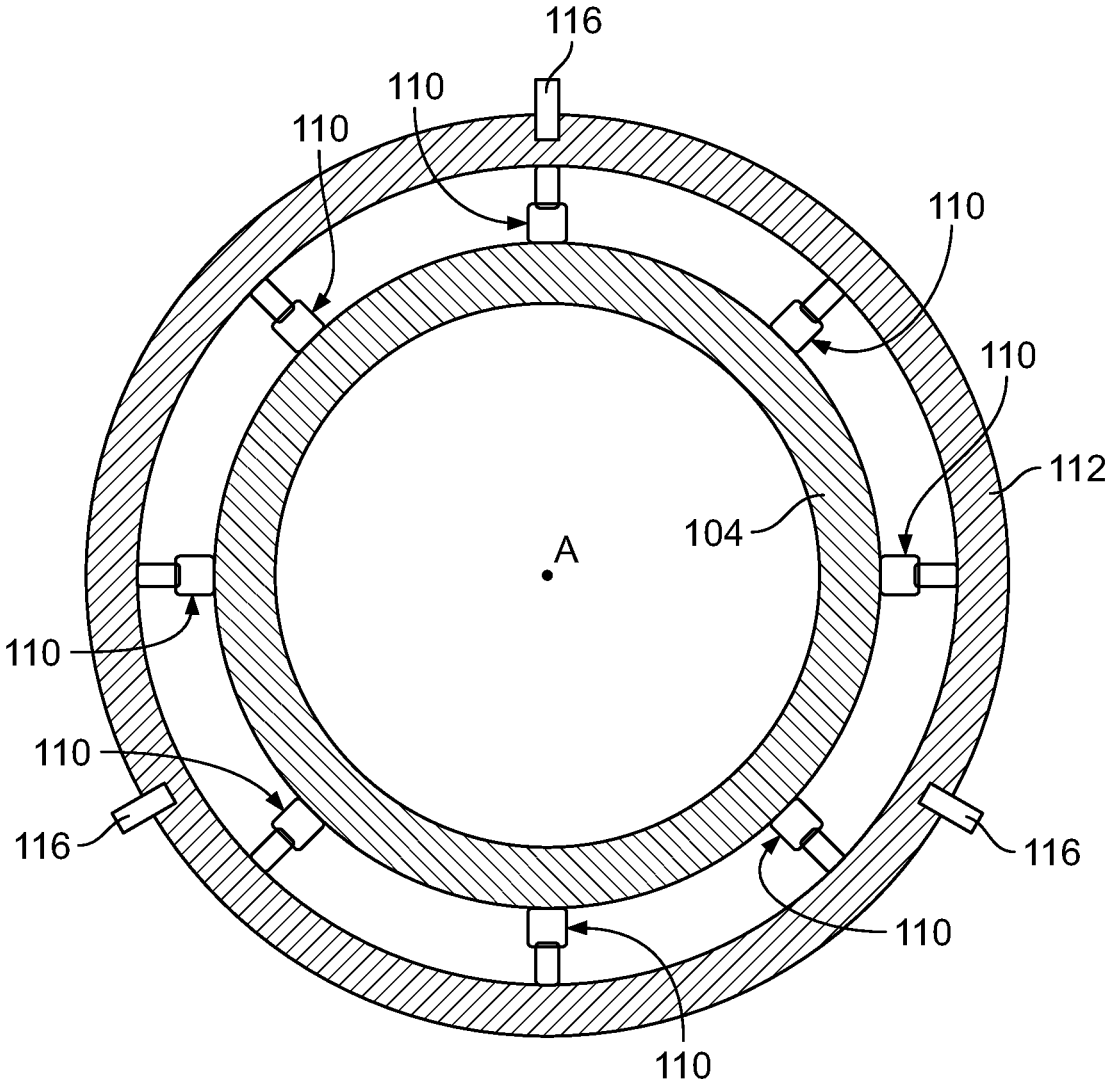
FIG. 2 is a schematic and cross sectional view of a blade tip clearance control assembly in accordance with some embodiments of the present disclosure.

In some embodiments the assembly 100 comprises three or more actuators 116 spaced about a circumference of the turbine casing 102. The use of multiple actuators 116 allows for a consistent and/or axisymmetric radial positioning of the blade tracks 118 about the outer circumference of the blades 122. The use of multiple actuators 116 may also allow for inconsistent or non-axisymmetric radial positioning of the blade tracks 118 if desired. FIG. 2 illustrates one such embodiment. FIG. 2 provides a cross sectional view taken normal to the axis of rotation of the gas turbine engine. For ease of comprehension, turbine casing 102, blade tracks 118, and blades 122 are not illustrated in FIG. 2.

A plurality of blade track carriers 104 comprise a segmented, annular member shown as blade track carrier 104. Each blade track carrier 104 comprises a ring engagement member 110. Although the illustrated embodiment discloses eight ring engagement members 110 spaced about the circumference of the turbine casing 102, more or less ring engagement members 110 may be used.

As explained above with reference to FIGS. 1A-1C, by actuating one or more actuators 116 the radial position of a blade track 118 may be adjusted. Actuating an actuator 116, for example by articulating a lever arm 130 of the actuator 116, causes axial movement of the control ring 112. Due to the shape of the control ring 112, namely that the radially inner track engagement surface 114 has a radial dimension that varies in the axial dimension, the axial movement of the control ring 112 is translated to radial movement of one or more blade track carriers 104 and, by extension, one or more blade tracks 118.

In some embodiments, all actuators 116 positioned about a circumference of a turbine casing 102 for a turbine stage 124 are actuated together. For example, the actuators 116 may be joined together by a unison ring, to ensure uniform positioning of the actuators 116 and therefore uniform radial positioning of the blade tracks 118. In such embodiments, the blade tracks 118 may have radially inner surfaces 120 that define an axisymmetric radially outer flowpath boundary of the turbine stage 124.

In other embodiments, one or more of the actuators 116 spaced about a circumference of a turbine casing 102 for a turbine stage 124 may be actuated independently of the other actuators 116. In some embodiments, each actuator 116 is actuated individually. In such embodiments, actuators 116 may be actuated independently of each other and a non-axisymmetric radially outer flowpath boundary of the turbine stage 124 may be formed by radially inner surface 120 having different radial positions relative to the blade tips 123. For example, if a single one of the actuators 116 shown in FIG. 2 is actuated to move the control ring 112 axially aft while the others of the actuators 116 are not actuated, then the blade track carriers 104 proximate the actuated actuator 116 would adjust in a radially inward manner and the blade tracks 118 carried by those blade track carriers 104 would adjust radially inward to create a non-axisymmetric flowpath boundary for the turbine stage 124. The present disclosure therefore provides the ability to define a non-axisymmetric flowpath boundary for a turbine stage 124. The use of non-axisymmetric flowpath boundaries may be beneficial for maintaining appropriate blade tip clearance when a bladed disk is rotating off-center or off-axis.

Although the figures herein illustrate an assembly for adjusting the radial position of one or more blade tracks in a single turbine stage 124, the present disclosure may be applied across multiple stages of a turbine. Thus, the present disclosure allows for the adjustment of flowpath boundaries of individual and independent stages, as well as the adjustment of axisymmetric and non-axisymmetric flowpath boundaries in one or more stages of a turbine.

Figure 3:
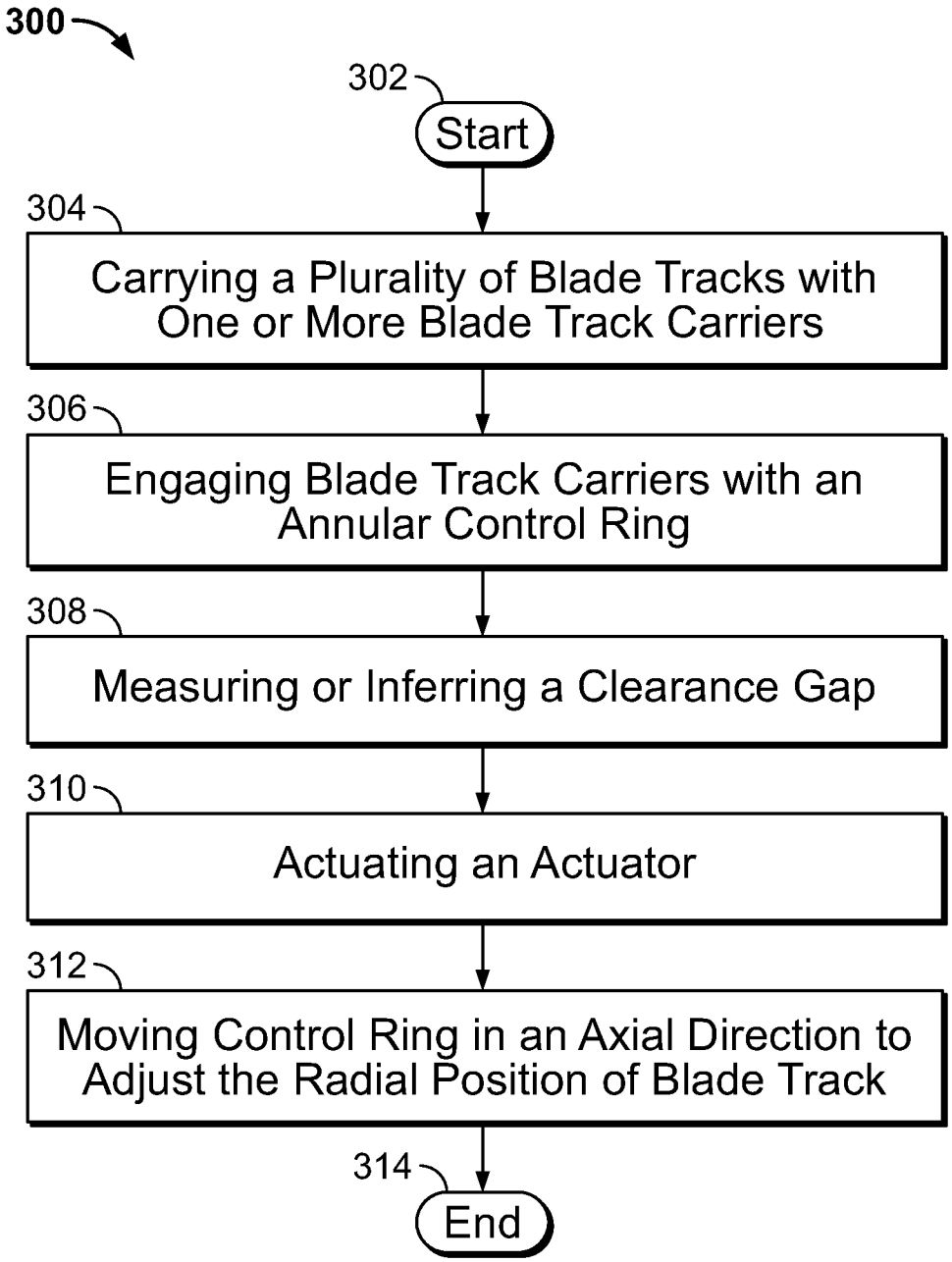
FIG. 3 is a flow diagram of a method in accordance with some embodiments of the present disclosure.

The present disclosure further provides method of controlling blade tip clearance and/or reducing blade tip rub. One such method 300 is presented in the flow diagram of FIG. 3. Method 300 starts at Block 302. The steps of method 300, presented at Blocks 302 through 314, may be performed in the order presented in FIG. 3 or in another order. One or more steps of the method 300 may not be performed. Method 300 may be performed in a turbine engine having a static turbine casing 102 and a turbine stage 124.

At Block 304 a plurality of blade tracks 118 may be carried with one or more blade track carriers 104. Each blade track 118 may comprise a radially inner surface 120 forming a portion of a radially outer flowpath boundary of the turbine stage 124.

At Block 306 one or more blade track carriers 104 may be engaged with an annular control ring 112. Each of the blade track carriers 104 comprises a carrier flange 108 and a ring engagement member 110 extending radially outward from the carrier flange 108. The control ring 112 may comprise a radially inner track engagement surface 114 having a radial dimension varying in an axial dimension.

At Block 308, a clearance gap between a blade tip 123 of the turbine stage 124 and the radially inner surface 120 of a blade track 118 may be measured on inferred. The blade tip clearance 125 may be measured, for example with sensors positioned at, in, on, or proximate the radially inner surface 120, or may be inferred, for example through the use of a parameter schedule that correlates various operating conditions of the engine with an expected clearance 125.

The control ring 112 may be coupled to an actuator 116. At Block 310, the actuator 116 may be actuated to move the control ring 112 in an axial direction. The actuator 116 may comprise a lever arm 130 coupled to the control ring 112 by one or more linkages 132, and the step of actuating the actuator 116 may comprise articulating the lever arm 130.

At Block 312 the control ring 112 may be moved in an axial direction while the control ring 112 is engaged with the ring engagement member 110 of the blade track carriers 104 to adjust the radial position of the radially inner surface 120 of the blade track 118.

Method 300 ends at Block 314.

The present disclosure presents several advantages over prior art systems for maintaining a blade tip clearance. The systems and methods disclosed in the present disclosure remove complex systems, particularly those requiring a steady supply of cooling air or other pneumatic fluid to maintain and control the radial position of a blade track. The disclosed systems herein are simpler and less expensive to manufacture and maintain. Additionally, the presently-disclosed systems and methods allow for the formation and control of a non-axisymmetric flowpath boundary of a turbine stage. Finally, the disclosed systems and methods provide for a rapid and precise adjustment of the radial position of a blade track.

Although the above embodiments are discussed with reference to a turbine of a gas turbine engine, the present disclosure may be applicable to compressors and compressor stages of a gas turbine engine as well. Further, the present disclosure may be applicable to other rotating machines having a turbine or compressor stage, and/or having a rotating bladed disk requiring blade tip clearance control.

Although examples are illustrated and described herein, embodiments are nevertheless not limited to the details shown, since various modifications and structural changes may be made therein by those of ordinary skill within the scope and range of equivalents of the claims.

What is claimed is:

1. An assembly for adjusting the radial position of one or more blade tracks radially encasing the blades of a turbine stage in a gas turbine engine, said assembly comprising:

a static turbine casing;

a plurality of blade track carriers carried by said casing, said plurality of blade track carriers forming a segmented annular member extending around a circumference of and radially inward of said turbine casing, each of said blade track carriers comprising a carrier flange and a ring engagement member extending radially outward from said carrier flange, wherein the turbine casing and the plurality of blade track carriers at least partly define an annulus separating the blade track carriers from the turbine casing wherein each of the blade track carriers is coupled to the turbine casing by a forward hoop, an aft hoop or both the forward hoop and the aft hoop;

an annular control ring carried by said turbine casing, said control ring being positioned radially outward of and in axial alignment with the ring engagement member of each blade track carrier, said control ring having a radially inner track engagement surface, the track engagement surface having a linear ramped planar surface providing a sloped radial dimension in an axial direction, and said ring engagement member of each blade track carrier being biased against the linear ramped planar surface by the forward hoop, the aft hoop, or both, such that movement of said control ring in the axial direction changes a volume of said annulus;

an actuator for moving said control ring in the axial direction while said control ring is engaged with the ring engagement members of said blade track carriers; and a plurality of blade tracks, each blade track being carried by a blade track carrier and having a radially inner surface forming at least a part of a radially outer flowpath boundary in a turbine stage.

2. The assembly of claim 1 wherein said actuator comprises a lever arm coupled to said control ring by one or more linkages.

3. The assembly of claim 1 wherein each blade track is biased in a radially outward direction via the forward hoop, the aft hoop, or both the forward hoop and the aft hoop.

4. The assembly of claim 1 wherein each blade track comprises a forward mount arm and an aft mount arm and each blade track carrier comprises a forward hook and aft hook, and wherein one or more of said plurality of blade tracks is carried by one or more of said plurality of blade track carriers with said forward mount arm engaged with said forward hook and said aft mount arm engaged with said aft hook.

5. The assembly of claim 1 wherein the radial position of one or more blade tracks are adjusted based on a sensed clearance gap between the blade track and the blades of the turbine stage.

6. The assembly of claim 1 wherein the radial position of one or more blade tracks are adjusted based on a predetermined clearance gap between the blade track and the blades of the turbine stage.

7. An assembly for adjusting the radial position of one or more blade tracks radially encasing the blades of a turbine stage in a gas turbine engine, said assembly comprising:

a static turbine casing;

a plurality of blade track carriers carried by said casing, said plurality of blade track carriers forming a segmented annular member extending around a circumference of and radially inward of said turbine casing, each of said blade track carriers comprising a carrier flange and a ring engagement member extending radially outward from said carrier flange, wherein each blade track carrier is coupled to the turbine casing and biased in a radially outward direction by a forward hoop, an aft hoop, or the a combination of the forward hoop and the aft hoop;

an annular control ring carried by said turbine casing, said control ring being positioned radially outward of and in axial alignment with the ring engagement member of each blade track carrier, said control ring having a radially inner track engagement surface having a radial dimension sloped in an axial direction such that a movement of said control ring in the axial direction along the track engagement surface causes radially outward or radially inward movement of said blade track carrier according to a respective axial direction of the movement of said control ring along the track engagement surface;

at least three actuators spaced about said circumference of said turbine casing, each actuator for moving said control ring in the axial direction while said control ring is engaged with the ring engagement members of said blade track carriers; and a plurality of blade tracks, each blade track being carried by a blade track carrier and having a radially inner surface forming at least a part of a radially outer flowpath boundary in a turbine stage.

8. The assembly of claim 7 wherein each of said at least three actuators are joined by a unison ring so that the at least three actuators actuate in unison to effect substantially uniform movement of the control ring in the axial direction.

9. The assembly of claim 8 wherein the radial position of one or more blade tracks is adjusted symmetrically with respect to an axis of rotation of the turbine stage by the substantially uniform movement of the control ring in the axial direction.

10. The assembly of claim 7 wherein each of said at least three actuators are adapted to be actuated individually to effect substantially non-uniform movement of the control ring in the axial direction.

11. The assembly of claim 10 wherein each of said at least three actuators are positioned such that the radial position of one or more blade tracks is adjusted asymmetrically with respect to an axis of rotation of the turbine stage.

12. The assembly of claim 7 wherein each of said at least three actuators comprises a lever arm coupled to said control ring by one or more linkages.

13. The assembly of claim 7 wherein each blade track is biased in a radially outward direction and angled relative to an axis of rotation of the turbine stage.

14. In a turbine engine having a static turbine casing and a turbine stage, a method of reducing blade tip rub comprising:

carrying a plurality of blade tracks with one or more blade track carriers, each blade track comprising a radially inner surface forming a portion of a radially outer flowpath boundary of said turbine stage;

wherein the turbine casing and plurality of blade track carriers at least partly define an annulus that spaces the blade track carriers from the turbine casing, wherein each blade track carrier is coupled to the turbine casing by a forward hoop an aft hoop or a combination of the forward hoop and the aft hoop; and engaging said one or more blade track carriers with an annular control ring, each of said blade track carriers comprising a carrier flange and a ring engagement member extending radially outward from said carrier flange and said control ring comprising a radially inner track engagement surface, the track engagement surface having a linear ramped planar surface providing a radial dimension varying in an axial direction, and said ring engagement member of each blade track carrier being biased against the linear ramped planar surface by the forward hoop, the aft hoop, or the combination, such that movement of said control ring in an axial direction changes a volume of said annulus, while said control ring is engaged with said ring engagement member of said blade track carriers to adjust a radial position of said radially inner surface of said blade track.

15. The method of claim 14 wherein said annular control ring is coupled to an actuator, the method further comprising:

actuating said actuator to move said control ring in an axial direction.

16. The method of claim 15 wherein said actuator comprises a lever arm coupled to said control ring by one or more linkages, and wherein the step of actuating the actuator comprises articulating the lever arm.

17. The method of claim 14 further comprising:

measuring a clearance gap between a blade tip of the turbine stage and the radially inner surface of said blade tracks; and moving said control ring in an axial direction responsive to the measured clearance gap.

18. The method of claim 14 further comprising:

inferring a clearance gap between a blade tip of the turbine stage and the radially inner surface of said blade tracks; and moving said control ring in an axial direction responsive to the inferred clearance gap.

19. The assembly of claim 1 wherein said ring engagement member comprises one or more rotatable wheels oriented radially outward from the carrier flange to contiguously contact the linear ramped planar surface of the track engagement surface.

20. The assembly of claim 1, wherein the volume of the annulus increases in response to movement of the control ring toward the aft hoop, and the volume of the annulus decreases in response to movement of the control ring toward the forward hoop.

* * * * *